US005863648A

United States Patent [19]

Ohmura et al.

[11] Patent Number: 5,863,648

[45] Date of Patent: Jan. 26, 1999

[54] CAST-COATED PAPER FOR INK JET RECORDING

[75] Inventors: Tomonobu Ohmura; Teruhisa Shimada; Takashi Ueno; Shunichi Teramasa; Yoshihiro Kuroyama, all of Tokyo, Japan

[73] Assignee: Nippon Paper Industries Co., Ltd., Japan

[21] Appl. No.: 760,570

[22] Filed: Dec. 4, 1996

[30] Foreign Application Priority Data

Dec. 5, 1995 [JP] Japan ..... 7-344545

[51] Int. Cl.[6] ..... B41M 5/00

[52] U.S. Cl. ..... 428/331; 428/195; 428/211; 428/329; 428/330; 428/342; 428/423.1; 428/478.2

[58] Field of Search ..... 428/195, 211, 428/331, 342, 537.5, 478.2, 423.1, 329, 330

[56] References Cited

U.S. PATENT DOCUMENTS 4,770,934 9/1988 Yamasaki et al. ..... 428/331

FOREIGN PATENT DOCUMENTS 634 285 A1 1/1995 European Pat. Off. .

OTHER PUBLICATIONS

Derwent Abstract AN 96–482803, Sep. 1996.

Derwent Abstract AN 94–276180, Jul. 1994.

Derwent Abstract AN 90–379954, Nov. 1990.

*Primary Examiner*—Pamela R. Schwartz
*Attorney, Agent, or Firm*—Millen, White, Zelano, & Branigan, P.C.

[57] ABSTRACT

Provided is a cast-coated paper suitable for ink jet recording which is produced in a process comprising a step of coating at least one side of a base paper with a coating composition comprising a pigment and a water base binder and a step of pressing the coated layer against a heated specular metal surface while the coated layer is in a wet condition; with the pigment comprising a synthetic silica having a BET specific surface area of 200–600 $m^2/g$ in a proportion of at least 40 weight %, and with the water base binder comprising an hydrophilic urethane resin and casein in a mixing ratio of from 0.1 to 20 by weight.

12 Claims, No Drawings

CAST-COATED PAPER FOR INK JET RECORDING

FIELD OF THE INVENTION

The present invention relates to an ink jet recording paper on which images are recorded with water base ink and, more particularly, to a cast-coated paper for ink jet recording which has no lowering of gloss in recorded areas and ensures higher quality in recorded images as well as excellent recording suitability.

BACKGROUND OF THE INVENTION

In an ink jet recording method, recording is generally carried out by jetting fine drops of ink using a variety of mechanisms so as to form images on a recording paper. Therefore, the recording method of ink jet type has advantages in that it is less noisy, can provide full-color prints with ease and enables high-speed printing, compared with the recording method of dot impact type.

For the paper used in such an ink jet recording method, it is usually required to have properties of (1) ensuring high-speed drying of ink, (2) being free from cissing, feathering and overflowing of ink, (3) providing recorded images of high optical density, and (4) causing no rippling trouble upon absorption of ink, and so on. It has already been proposed to prepare ink jet recording papers partaking all the properties mentioned above by the use of a cast coating method (e.g., in Japanese Tokkai Sho 62-95285, Japanese Tokkai Sho 62-264391 and Japanese Tokkai Hei 02-274587, wherein the term "Tokkai" as used herein means an "unexamined published patent application").

In addition, ink jet printers have had remarkable development in recent years, so that they have come to ensure considerable colorfulness and vividness in the recorded images. Thus, recording media also have been required to be higher grade merchandise. As matters now stand, it is known that higher grade recorded image which can give such a feeling of higher quality as those provided by photography or high grade printed matter can be obtained by choosing a recording medium having a glossy surface.

However, the need for reduction in running cost has also grown in proportion as prices of ink jet printers have declined. Since most of glossy recording media on the market use as their substrates more expensive materials, such as plastic films or laminated papers, they cannot meet the aforesaid need.

In contrast to the recording media on the market in which films or the like are used as substrate, cast-coated paper uses low-priced paper as a substrate and can be prepared in a relatively simple process, so that it has the advantage of a substantially lower cost. Further, as the recording side of cast-coated paper can be rendered glossy, the cast-coated paper is suitable for ink jet recording paper which can give a feeling of high quality and can provide high grade recorded images at a lower price.

The cast-coated paper mentioned above is a highly glossy coated paper prepared by pressing a coated layer comprising a pigment containing a synthetic silica as main component and a water base binder against a specular surface-finished metal surface while the coated layer is in a wet condition, and reproducing the specular surface on the surface of the coated layer simultaneously with drying of the coated layer.

In general, cast-coated paper improves its ink-cissing and feathering properties, dot shape and gloss on the recorded surface by containing therein casein as a water base binder, and utilizing a pigment having a large specific surface area or controlling a void content therein (Japanese Tokkai Hei 06-72017, etc.). In this case, however, the glossy part of cast-coated paper swells by the contact with water base ink. Thus, the cast-coated paper suffers a defect that the gloss in an image area becomes lower than that in a non-image area when cast-coated paper undergoes ink jet recording.

SUMMARY OF THE INVENTION

As a result of our intensive studies of the aforesaid problem, it has been found that the swelling phenomenon caused in cast-coated paper due to recording with water base ink can be inhibited by employing a mixture of casein with a specified proportion of hydrophilic urethane resin as the water base binder used in the coating composition for the cast-coated paper. This results in preventing the gloss in the image area from lowering, thereby achieving the present invention.

Therefore, an object of the present invention is to provide a cast-coated paper for ink jet recording which is prepared at a low price and not only gives a feeling of high quality but also ensures high grade characteristics in the recorded image without loss of gloss in the image area.

The aforementioned object is attained by a cast-coated paper for ink jet recording which is produced in a process comprising a step of coating at least one side of a base paper with a coating composition comprising a pigment and a water base binder and a step of pressing the coated layer against a heated specular metal surface while the coated layer is in a wet condition; with the pigment comprising a synthetic silica having a BET specific surface area of 200–600 $m^2/g$ in a proportion of at least 40 weight %, and with the water base binder comprising an hydrophilic urethane resin and casein in a mixing ratio of from 0.1 to 20 by weight.

DETAILED DESCRIPTION OF THE INVENTION

In the present invention, it is required that the ratio of an hydrophilic urethane resin to casein (the hydrophilic urethane resin/casein ratio) in the water base binder be from 0.1 to 20 by weight.

In proportion as the hydrophilic urethane resin/casein ratio is increased, the glossy side of cast-coated paper becomes hard to swell in water, and thereby the gloss in the recorded area is readily retained.

On the other hand, since an hydrophilic urethane resin is inferior to casein in ink absorbency, the ink absorbency of the cast-coated paper decreases with an increase in the aforesaid ratio, and thereby cissing, overflowing and feathering of ink tend to occur. In addition, it becomes hard to form ink dots having higher circularity on the cast-coated paper when an ink jet recording method is adopted therein; as a result, the image obtained tends to lack vividness. Thus, it is required to control the hydrophilic urethane resin/casein ratio to no greater than 20.

Conversely, a decrease in the aforesaid ratio, although it can bring about higher ink absorbency, makes the glossy side of the cast-coated paper be apt to swell in water, and thereby the gloss in the recorded area tends to be lowered. Therefore, it is required to adjust the hydrophilic urethane resin/casein ratio to no less than 0.1. In particular, it is desirable for this ratio to be in the range of 0.5 to 10 from the viewpoint of not only ensuring ink jet recording suitability with respect to, e.g., ink absorbency and dot shape, but also inhibiting the gloss in the recorded area from lowering.

The hydrophilic urethane resins employed in the present invention are those prepared by the reaction of polyols, including diols and triols as representatives thereof, with polyisocyanates. Those urethane resins are used in a water-based state, such as in the form of aqueous emulsion or colloidal dispersion. Specific examples of such polyols include generally used glycols, such as neopentyl glycol, 1,4-butanediol and 1,6-hexanediol; polyether glycols represented by polyethylene glycol, polypropylene glycol and polytetramethylene glycol; and other polyols, such as polyester polyol, acrylpolyol, epoxypolyol and polycarbonate polyol. In addition, tertiary amine-containing diols, such as N-methyldiethanolamine, and carboxyl group-containing diols, such as dimethylolpropionic acid, can also be employed in the foregoing reaction.

Therefore, the term "hydrophilic urethane resin" as used in the present invention is intended to include epoxy resin- or acrylic resin-modified urethane resins in addition to conventional hydrophilic urethane resins.

As specific examples of isocyanates usable in the reaction for producing hydrophilic urethane resins, mention may be made of toluene diisocyanate, 4,4'-diphenylmethane diisocyanate, xylene diisocyanate, hexamethylene diisocyanate, lysine diisocyanate, 4,4'-cyclohexyldiisocyanate, methylcyclo-hexane-2, 4(2,6)-diisocyanate, 1,3-cyclohexane diisocyanate, isophorone diisocyanate, trimethylhexamethylene diisocyanate and dimer acid diisocyanate.

The proportion of water base binder in the present coating composition has no particular limitations in principle, so far as the binder can secure a sufficiently bound state for the pigment used and does not fail in providing the ink absorbency required for ink jet recording. More specifically, it can be properly chosen depending on the specific surface area of silica used as a pigment component, the composition of the pigment used, the composition of water base binder used, and so on. In particular, it is desirable that the water base binder in an amount of 10–100 parts by weight (on a solids basis) be mixed with 100 parts by weight of pigment.

In the coated layer, other conventional binding materials also can be present together with the present casein and hydrophilic urethane resin, provided that those binding materials cause no damage to ink jet recording suitability and gloss of the intended recording paper. Specific examples of a binding material usable together with the present binder include starch and derivatives thereof, such as oxidized starch and esterified starch; cellulose derivatives, such as carboxymethyl cellulose and hydroxyethyl cellulose; and polyvinyl alcohol, polyvinyl pyrrolidone, gelatin, soybean protein, styrene-acrylic resin, styrene-butadiene latex, acrylic resins, vinyl acetate resins, vinyl chloride resins, urea resins, alkyd resins, and derivatives of those polymers.

The synthetic silica used in the present invention includes silica gel, white carbon and anhydrous silica as described in *Kagaku Binran* (which means "Handbook of Chemistry"), Oyo Kagaku Hen (which means "Volume of Applied Chemistry"), pp. 256–258 (compiled by Japanese Chemical Society, published by Maruzen in Oct. 15, 1986). As for the specific surface area of synthetic silica, the synthetic silica used in the present invention is required to have its BET specific surface area in the range of 200 to 600 $m^2/g$ from the standpoint of satisfying all the requirements for quality, operability and productivity. In particular, it is advantageous to the present invention that the synthetic silica used has its BET specific surface area in the range of 200 to 450 $m^2/g$.

When the specific surface area of synthetic silica used is small, the water absorbing capacity of the cast-coated layer is lowered, and thereby the cissing, overflowing and feathering of ink are caused when the resultant cast-coated paper is used as recording material, that is, the ink jet recording suitability of the resultant coat-coated paper is impaired.

When the synthetic silica used has too large a specific surface area, on the other hand, the coating composition containing such silica increases its viscosity during the coating operation suffering damage coating suitability. It also tends to remove a release promoting substance from the specular metal surface during the drying operation because such silica can adsorb the release promoting substance coated on the specular metal surface for easy release of paper, thereby lowering the continuous operability causing damage to productivity.

When the proportion of synthetic silica to the total pigment is low, sufficient ink absorbency cannot be ensured in the cast-coated layer, thereby causing a deficiency of recording suitability. Therefore, it is required that the proportion of synthetic silica to the total pigment be not lower than 40 weight %. In particular, the cases where the aforesaid proportion is not lower than 60 weight % are advantageous.

As for the pigment which can be used together with the synthetic silica, kaolin, talc, calcium carbonate, titanium dioxide, clay, zinc oxide, aluminum hydroxide and alumina are examples thereof.

The present coating composition containing the aforementioned pigment and water base binder is generally prepared in the form of an aqueous coating composition. To this coating composition can be optionally added known additives, such as a pigment dispersing agent, a water retaining agent, a thickening agent, an anti-foaming agent, an antiseptic, a coloring agent, a water proofing agent, a wetting agent, a plasticizer, a fluorescent dye, an ultraviolet absorbent, a stripping agent, a mold releasing agent and a cationic polyelectrolyte.

The method for coating the present coating composition can be properly selected from the methods using known coating machines, such as a blade coater, an air knife coater, a roll coater, a comma coater, a brush coater, a squeegee coater, a curtain coater, a bar coater and a gravure coater.

In the cast coating operation performed in the present invention, any of a direct process, a rewetting process and a coagulation process can be adopted.

When a coagulation process, in which the coated layer in a wet state is brought into a gelled condition by coagulation, is chosen in pressing the wet coated layer against the heated specular metal surface, a coagulating solution containing a coagulant is applied to the coated layer in order to cause coagulation therein.

The coagulant used therein can be properly selected from various salts formed from metals, such as calcium, zinc, barium, lead, potassium, sodium, ammonium, magnesium, cadmium, etc., aluminum, and acids, such as formic acid, acetic acid, citric acid, tartaric acid, lactic acid, hydrochloric acid, sulfuric acid, carbonic acid, etc.; borax; and boric acid. Additionally, two or more of the coagulants as recited above may be used together.

The heated specular metal surface utilized in the present invention is a specular surface-finished cylindrical outer face of a metallic drum which is heated to about 100° C.

For the coverage rate of the cast-coated layer, it is desirable to be in the range of 10 to 30 $g/m^2$ from the viewpoint of ensuring both high recorded-image density and sufficient ink absorption in the ink jet recording.

When the coverage rate is increased beyond 30 $g/m^2$, the capacity for absorbing ink is increased to improve the ink absorbency, and thereby the cissing, overflowing and feathering of ink are hard to occur. However, as the ink permeated into the coated layer and raw paper is covered up by upper part of the coated layer, the recorded-image density tends to be lowered. When the coverage rate is decreased below 10 $g/m^2$, on the other hand, the recorded-image density and the ink absorbency have tendencies opposite to those in the foregoing higher coverage rate case.

In the present cast-coated paper for ink jet recording, not only can the coated layer be provided on one side alone, but also the coated layer can be provided on both sides to make both-sided ink jet recording possible. Moreover, the present cast-coated paper is suitable especially for full-color ink jet recording since it can provide high gloss in the image recorded area as well as high recorded-image density although it has good ink absorbency.

In accordance with the present invention, the combination of casein with a hydrophilic urethane resin is used as a binder in the coated layer, and thereby desirable gloss can be ensured in not only a non-image area but also an image area as the image density and the ink absorbency are kept sufficiently high.

The present invention will now be illustrated in more detail by reference to the following examples. However, the invention should not be construed as being limited to these examples. Unless otherwise noted, all "%" and all "parts" in the examples are by weight.

EXAMPLE 1

An aqueous coating composition having a solids concentration of 30% was prepared. Therein, the solids were constituted of, as a pigment, 100 parts of synthetic silica having the BET specific surface area of 320 $m^2/g$ (Mizukasil P-87, commercial name, produced by Mizusawa Industrial Chemicals, K.K.), as a binder, a mixture of 10 parts of styrene-butadiene latex (JSR-0617, commercial name, produced by Japan Synthetic Rubber Co., Ltd.), 30 parts of casein (a product of New Zealand) and 30 parts of a hydrophilic urethane resin (BariaStar XUD-2120, commercial name, produced by Mitsui Toatsu Chemicals Inc.) and, as a stripping agent, 5 parts of calcium stearate (Nopcoat SYC, commercial name, produced by San Nopco Ltd.).

Then, one side of the base paper was coated with the coating composition prepared above for a recording layer by means of a comma coater at the intended coverage rate of 18 $g/m^2$, and then treated with the coagulation solution prepared below. Subsequently thereto, the coated surface was pressed against a specular surface-finished metal surface heated to 100° C. while it was in a wet condition, and then dried. Thus, a cast-coated paper for ink jet recording was produced.

<Preparation of Coagulating Solution>

A coagulating solution containing 5% of calcium formate as a coagulant and 1% of a cationic polyelectrolyte (Dyefix YK-50, commercial name, produced by Daiwa Chemical Industries, Ltd.) as a water proofing agent were prepared.

EXAMPLE 2

A cast-coated paper for ink jet recording was produced in the same manner as in Example 1, except that the same synthetic silica as in Example 1 was used in the amount of 150 parts.

EXAMPLE 3

A cast-coated paper for ink jet recording was produced in the same manner as in Example 1, except that the same casein as in Example 1 was used in the amount of 40 parts and the same hydrophilic urethane resin as in Example 1 was used in the amount of 20 parts.

EXAMPLE 4

A cast-coated paper for ink jet recording was produced in the same manner as in Example 1, except that the same casein as in Example 1 was used in the amount of 45 parts and the same hydrophilic urethane resin as in Example 1 was used in the amount of 15 parts.

EXAMPLE 5

A cast-coated paper for ink jet recording was produced in the same manner as in Example 1, except that the same casein as in Example 1 was used in the amount of 50 parts and the same hydrophilic urethane resin as in Example 1 was used in the amount of 10 parts.

EXAMPLE 6

A cast-coated paper for ink jet recording was produced in the same manner as in Example 1, except that the same casein as in Example 1 was used in the amount of 15 parts and the same hydrophilic urethane resin as in Example 1 was used in the amount of 45 parts.

EXAMPLE 7

A cast-coated paper for ink jet recording was produced in the same manner as in Example 1, except that the same casein as in Example 1 was used in the amount of 6 parts and the same hydrophilic urethane resin as in Example 1 was used in the amount of 54 parts.

EXAMPLE 8

A cast-coated paper for ink jet recording was produced in the same manner as in Example 1, except that the same casein as in Example 1 was used in the amount of 5 parts and the same hydrophilic urethane resin as in Example 1 was used in the amount of 55 parts.

EXAMPLE 9

A cast-coated paper for ink jet recording was produced in the same manner as in Example 1, except that the same casein as in Example 1 was used in the amount of 3 parts and the same hydrophilic urethane resin as in Example 1 was used in the amount of 57 parts.

EXAMPLE 10

A cast-coated paper for ink jet recording was produced in the same manner as in Example 1, except that the pigment used was changed to a mixture of 40 parts of the same synthetic silica as used in Example 1 with 60 parts of columnar calcium carbonate (Tama Pearl #123, commercial name, produced by Okutama Kogyo Co., Ltd.).

EXAMPLE 11

A cast-coated paper for ink jet recording was produced in the same manner as in Example 1, except that the pigment used was changed to 100 parts of synthetic silica having the BET specific surface area of 600 $m^2/g$ (Syloid 800, commercial name, produced by Fuji Davison K. K.).

EXAMPLE 12

A cast-coated paper for ink jet recording was produced in the same manner as in Example 1, except that the intended coverage rate was changed to 11 $g/m^2$.

EXAMPLE 13

A cast-coated paper for ink jet recording was produced in the same manner as in Example 1, except that the intended coverage rate was changed to 29 g/m$^2$.

Comparative Example 1

A cast-coated paper for ink jet recording was produced in the same manner as in Example 1, except that the hydrophilic urethane resin as a binder component was not used at all and the amount of casein used was increased to 60 parts.

Comparative Example 2

A cast-coated paper for ink jet recording was produced in the same manner as in Example 1, except that a mixture of 15 parts of the same styrene-butadiene latex as in Example 1 with 60 parts of the same hydrophilic urethane resin as in Example 1 was used as the binder.

Comparative Example 3

A cast-coated paper for ink jet recording was prepared in the same manner as in Example 1, except that the same casein as in Example 1 was used in the amount of 57 parts and the same hydrophilic urethane resin as in Example 1 was used in the amount of 3 parts.

Comparative Example 4

A cast-coated paper for ink jet recording was prepared in the same manner as in Example 1, except that the same casein as in Example 1 was used in the amount of 2 parts and the same hydrophilic urethane resin as in Example 1 was used in the amount of 58 parts.

Comparative Example 5

A cast-coated paper for ink jet recording was prepared in the same manner as in Example 1, except that 100 parts of synthetic silica having the BET specific surface area of 180 m$^2$/g (Mizukasil P-802, commercial name, produced by Mizusawa Industrial chemicals K.K.) was used as the pigment and the same casein as in Example 1 was used in the amount of 2 parts.

Comparative Example 6

A cast-coated paper for ink jet recording was produced in the same manner as in Example 1, except that the pigment used was changed to a mixture of 35 parts of the same synthetic silica as used in Example 1 with 65 parts of columnar calcium carbonate (Tama Pearl #123, commercial name, produced by Okutama Kogyo Co., Ltd.).

The cast-coated papers produced in the above Examples and Comparative Examples were each examined for recording properties in the following ways. Those properties were evaluated using the criteria described below respectively. The evaluation results thus obtained are shown in Table 1.

Recording suitability for ink jet recording method:

1) In order to examine recording suitability for ink jet recording method, attention was paid to ink absorbency of a cast-coated paper. Specifically, on each of the cast-coated paper samples, a black solid pattern was recorded by means of a full color ink jet printer, and thereby the extents of cissing, overflowing and feathering of ink respectively were evaluated by visual observation according to the following criteria:
   No defect was observed in the recorded pattern . . . ◎
   Although some defects were observed in the recorded pattern, the recording quality was above the lowest acceptable level . . . ○
   Defects were clearly observed in the recorded pattern . . . x
2) As an index to a vivid image, the circularity factor of a dot shape was determined by means of an image processing apparatus, and evaluated by the following criterion;
   Circularity factor of 0.75 or above . . . ○
   Circularity factor of no smaller than 0.5 and smaller than 0.75 . . . Δ
   Circularity factor of smaller than 0.5 . . . x
3) The recording quality was evaluated by paying attention to a gloss change in the recorded area. Specifically, the 750° gloss on the surface of a recording layer before and after ink jet recording were examined according to the method defined in JIS P 8142. The changes in gloss determined were evaluated by the following criterion;
   The gloss after recording was higher than that before recording by at least 3 points . . . ◎
   The gloss after recording was almost equal to that before recording or higher than that before recording by below 3 points . . . ○
   The gloss after recording was lower than that before recording by below 3 points . . . x
   The gloss after recording was lower than that before recording by at least 3 points . . . xx

TABLE 1

| | Urethane/ casein ratio | Synthetic silica content in pigment (wt %) | BET specific surface area* (m$^2$/g) | Proportion** of water base binder (pts.wt.) | Coverage rate (g/m$^2$) | Recording Suitability: cissing | Recording Suitability: Ink overflowing | Recording Suitability: feathering | Recording Suitability: Dot shape | Gloss change by recording |
|---|---|---|---|---|---|---|---|---|---|---|
| Example 1 | 1 | 100 | 320 | 70 | 18 | ◎ | ◎ | ◎ | ○ | ◎ |
| Example 2 | 1 | 100 | 320 | 46 | 18 | ◎ | ◎ | ◎ | ○ | ◎ |
| Example 3 | 0.5 | 100 | 320 | 70 | 18 | ◎ | ◎ | ◎ | ○ | ○ |
| Example 4 | 0.33 | 100 | 320 | 70 | 18 | ◎ | ◎ | ◎ | ○ | ○ |
| Example 5 | 0.2 | 100 | 320 | 70 | 18 | ◎ | ◎ | ◎ | ○ | ◎ |
| Example 6 | 3 | 100 | 320 | 70 | 18 | ◎ | ◎ | ◎ | ○ | ◎ |
| Example 7 | 9 | 103 | 320 | 70 | 18 | ◎ | ◎ | ◎ | ○ | ◎ |
| Example 8 | 11 | 100 | 320 | 70 | 18 | ○ | ◎ | ○ | Δ | ◎ |
| Example 9 | 19 | 100 | 320 | 70 | 18 | ○ | ○ | ○ | Δ | ◎ |
| Example 10 | 1 | 40 | 320 | 70 | 18 | ○ | ○ | ○ | Δ | ◎ |
| Example 11 | 1 | 100 | 600 | 70 | 18 | ◎ | ◎ | ◎ | ○ | ◎ |

TABLE 1-continued

| | Urethane/ casein ratio | Synthetic silica content in pigment (wt %) | BET specific surface area* ($m^2/g$) | Proportion** of water base binder (pts.wt.) | Coverage rate ($g/m^2$) | Recording Suitability: cissing | Ink overflowing | feathering | Dot shape | Gloss change by recording |
|---|---|---|---|---|---|---|---|---|---|---|
| Example 12 | 1 | 100 | 320 | 70 | 11 | ⊙ | ○ | ○ | ○ | ⊙ |
| Example 13 | 1 | 100 | 320 | 70 | 29 | ⊙ | ⊙ | ⊙ | ○ | ⊙ |
| Compar. Ex. 1 | 0 | 100 | 320 | 70 | 18 | ⊙ | ⊙ | ⊙ | ○ | xx |
| Compar. Ex. 2 | ∞ | 100 | 320 | 70 | 18 | x | ○ | x | x | ⊙ |
| Compar. Ex. 3 | 0.05 | 100 | 320 | 70 | 18 | ⊙ | ⊙ | ⊙ | ○ | x |
| Compar. Ex. 4 | 29 | 100 | 320 | 70 | 18 | x | ○ | ○ | x | ⊙ |
| Compar. Ex. 5 | 1 | 100 | 180 | 70 | 18 | ○ | x | x | Δ | ⊙ |
| Compar. Ex. 6 | 1 | 35 | 320 | 70 | 18 | ○ | x | x | x | ⊙ |

In the above Table 1, the mark * means that the BET specific surface area is that of a synthetic silica used, and the mark ** means that the proportion is per 100 parts by weight of pigment.

Additionally, the cast-coated paper produced in Example 11 was somewhat inferior in continuous operability, and that produced in Example 13 was more or less low in recorded-image density.

What is claimed is:

1. A cast-coated paper for ink jet recording which is produced in a process comprising a step of coating at least one side of a base paper with a coating composition comprising a pigment and a water base binder and a step of pressing the coated layer against a heated specular metal surface while the coated layer is in a wet condition, said pigment comprising a synthetic silica having a BET specific surface area of 200–600 $m^2/g$ in a proportion of at least 40 weight %, and said water base binder comprising an hydrophilic urethane resin and casein in a mixing ratio of from 0.1 to 20 by weight.

2. A cast-coated paper for ink jet recording as described in claim 1, wherein the BET specific surface area of the synthetic silica is from 200 to 450 $m^2/g$.

3. A cast-coated paper for ink jet recording as described in claim 1, wherein the mixing ratio of the hydrophilic urethane resin to the casein is from 0.5 to 10 by weight.

4. A cast-coated paper for ink jet recording as described in claim 1, wherein the proportion of the synthetic silica in the pigment is at least 60 weight %.

5. A cast-coated paper for ink jet recording as described in claim 1, wherein the proportion of the water base binder in the coating composition is 10–100 parts by weight on a solids basis to 100 parts by weight of the pigment.

6. The cast-coated paper of claim 1, wherein the synthetic silica is a silica gel, white carbon or anhydrous silica.

7. The cast-coated paper of claim 1, wherein the pigment additionally comprises kaolin, talc, calcium carbonate, titanium dioxide, clay, zinc oxide, aluminum hydroxide or alumina.

8. The cast-coated paper of claim 1, wherein the specular metal surface is heated to about 100° C.

9. The cast-coated paper of claim 1, wherein the coating composition is coated on the base paper at coverage rate of 10 to 30 $g/m^2$.

10. The cast-coated paper of claim 1, wherein both sides of the base paper are coated with a coating composition and pressed.

11. The cast-coated paper of claim 1, wherein, before pressing, the coated layer in a wet state is gelled by addition of coagulating solution containing a coagulant thereto.

12. The cast-coated paper of claim 1, wherein the coagulant is a metal salt.

* * * * *